US005224995A

United States Patent [19]

Shibamoto

[11] Patent Number: 5,224,995

[45] Date of Patent: Jul. 6, 1993

[54] APPARATUS FOR APPLYING A COATING TO A SURFACE OF A SUBSTRATE

[75] Inventor: Kazuhiro Shibamoto, Yamanashi, Japan

[73] Assignees: Pioneer Electronic Corporation, Tokyo; Pioneer Video Corp., Yamanashi, both of Japan

[21] Appl. No.: 819,646

[22] Filed: Jan. 10, 1992

Related U.S. Application Data

[63] Continuation of Ser. No. 509,835, Apr. 17, 1990, abandoned.

[30] Foreign Application Priority Data

Oct. 24, 1989 [JP] Japan ..... 1-124479

[51] Int. Cl.[5] ..... B05C 1/08

[52] U.S. Cl. ..... 118/249; 118/203; 118/261; 15/256.51

[58] Field of Search ..... 118/203, 249, 261, 122, 118/126; 15/256.5, 256.51

[56] References Cited

U.S. PATENT DOCUMENTS

| | | | |
|---|---|---|---|
| 3,145,118 | 8/1964 | Mahoney | 118/249 X |
| 3,450,098 | 6/1969 | Williams, Jr. | 118/126 |
| 4,300,476 | 11/1981 | Jurascheck et al. | 118/249 X |
| 4,651,672 | 3/1987 | Sommer | 118/261 |
| 4,661,380 | 4/1987 | Tillotson | 118/261 X |
| 4,718,373 | 1/1988 | Zodrow | 118/261 |

FOREIGN PATENT DOCUMENTS

| | | |
|---|---|---|
| 2564337 | 11/1985 | France . |
| 58-6536 | 1/1983 | Japan . |
| WO8903259 | 4/1989 | PCT Int'l Appl. . |
| 2104412 | 3/1983 | United Kingdom . |

*Primary Examiner*—W. Gary Jones
*Assistant Examiner*—Todd J. Burns
*Attorney, Agent, or Firm*—Sughrue, Mion, Zinn, Macpeak & Seas

[57] ABSTRACT

An apparatus for applying a coating to a surface of a substrate which includes a feeder for feeding the coating to a predetermined position, a roller for applying the coating onto the surface of the substrate to be coated from the feeder and a doctor for regulating a thickness of the coating applied to the roller, the doctor having a rake surface, a facing surface and a flank surface forming an escape angle with the facing surface confronted with the surface of the roller. The escape angle defined between a tangential plane with which the roller is contacted and an extension plane of the flank surface at an intersection defined between the extension plane and the roller is an obtuse angle.

2 Claims, 3 Drawing Sheets

APPARATUS FOR APPLYING A COATING TO A SURFACE OF A SUBSTRATE

This is a continuation of application Ser. No. 07/509,835 filed Apr. 17, 1990, now abandoned.

BACKGROUND OF THE INVENTION

This invention relates to an apparatus for applying a coating to a surface of a substrate at a constant coating thickness.

A conventional roll coater is shown in FIG. 3. The conventional apparatus includes a lower roller 1, and an associated upper roller 3 which are rotated while clamping therebetween a substrate 2 to be coated. A coating 5 is supplied to a surface of the upper roller 3 from a feeder 4 for applying the coating 5 to the upper roller 3, and the coating 5 applied by the feeder 4 is coated on the surface of the upper roller 3 at a uniform thickness to form a coating layer 7 by using a doctor 6. The upper roller 3 rotates on the substrate 2 with the coating layer 7 being applied onto the surface of the substrate 2.

In the conventional apparatus, the coating 5 applied on the surface of the upper roller 3 by the feeder 4 is likely to be piled, because the coating 5 applied by the feeder 4 spreads onto a flank or escape surface, i.e., the surface opposite to a rake surface 6*a* of a doctor 6. Therefore, the coating accumulated on the flank surface of the doctor 6 will drop onto the surface of the substrate 2 so that the coating dropped onto the substrate is adhered thereto in the form of an undesired protrusion.

SUMMARY OF THE INVENTION

It is an object of the present invention to solve the foregoing problems and to provide an apparatus for applying a coating such as a roll coater which is prevented from dropping the coating onto the surface of the substrate. An apparatus for applying a coating to a surface of a substrate comprises means for feeding the coating to a predetermined position, a roller means for applying the coating onto the surface of the substrate to be coated from the feeding means and a doctor means for regulating a thickness of the coating applied to the roller means, the doctor means having a rake surface, a facing surface and a flank surface forming an escape angle with the facing surface confronted with the surface of the roller, wherein the escape angle defined between a tangential plane with which the roller means is contacted and an extension plane of the flank surface at an intersection defined between the extension plane and roller means is an obtuse angle.

In the structure of the roller coater of the present invention, the coating scraped by the rake surface of the doctor could not move along and over the flank surface of the doctor, and is all formed on the surface of the upper roller as the constant thickness coating.

DETAILED DESCRIPTION OF THE PREFERRED EMBODIMENTS

Figure 1:
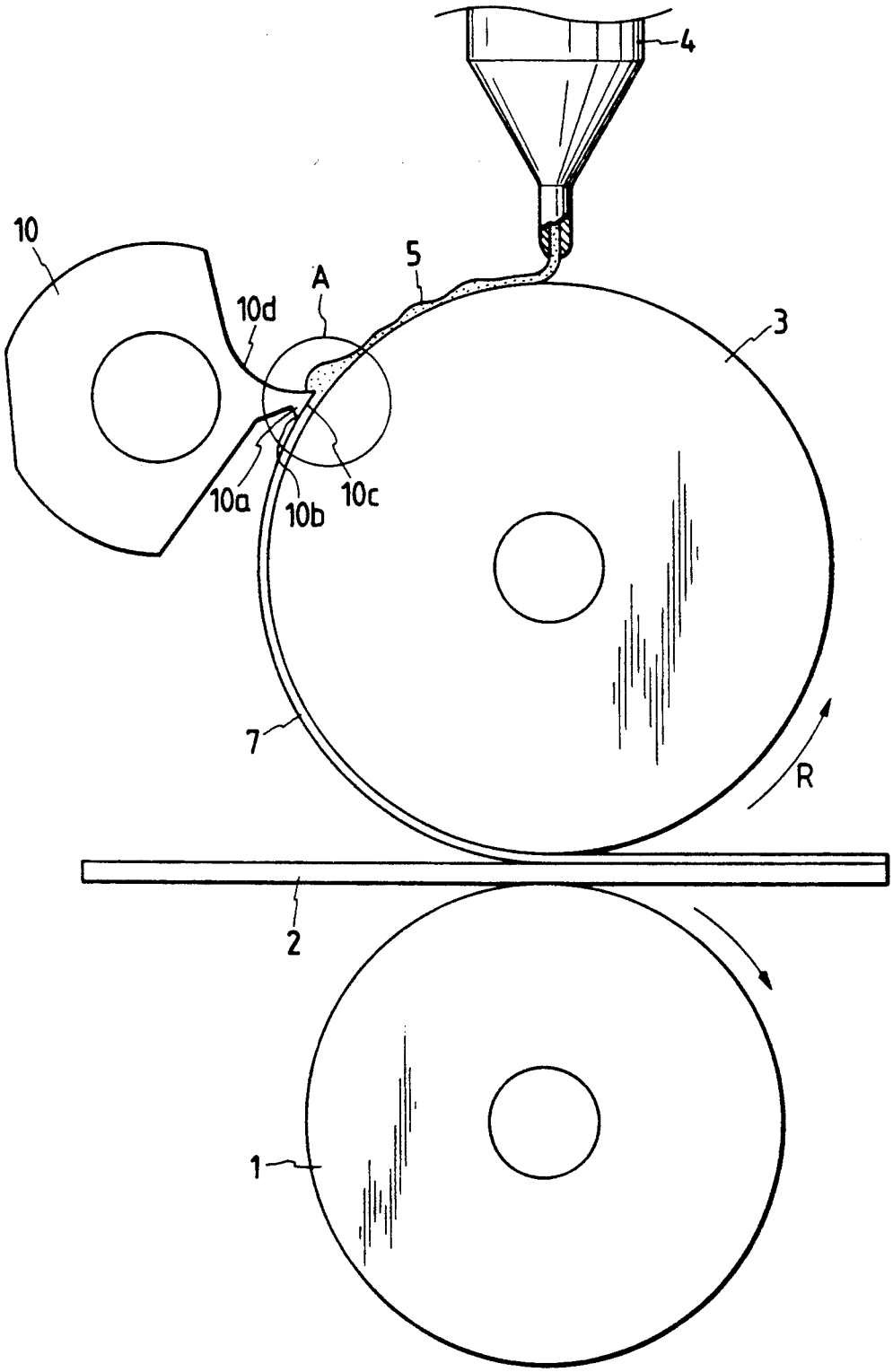
FIG. 1 is a partially fragmentary sectional view showing a roll coater according to a preferred embodiment of the present invention.

One example of a roller coater according to this invention will now be described with reference to FIGS. 1 and 2. The roller coater according to the present invention is composed of substantially the same components as those shown in FIG. 3 except for the parts described hereinbelow. Accordingly the duplicated description therefore will be omitted. In the apparatus of the present invention, the like members and components are designated by the same reference characters.

In the embodiment shown in FIG. 1, a doctor 10 for regulating a coating 5 continuously applied to a surface of an upper roller 3 by a feeder 4 for applying the coating 5 to the surface of the upper roller 4 as a coating layer 7 at a constant thickness has a sharp knife edge portion 10*a* with a flank or escape surface 10*b* and a facing surface 10*c*. The facing surface 10*c* of the edge portion 10*a* is confronted with the surface of upper roller 3, and is extended toward the upper roller 3 along the circumference of the upper roller 3. The flank surface 10*b* is placed in the opposite side to the facing surface 10*c*.

Figure 2:
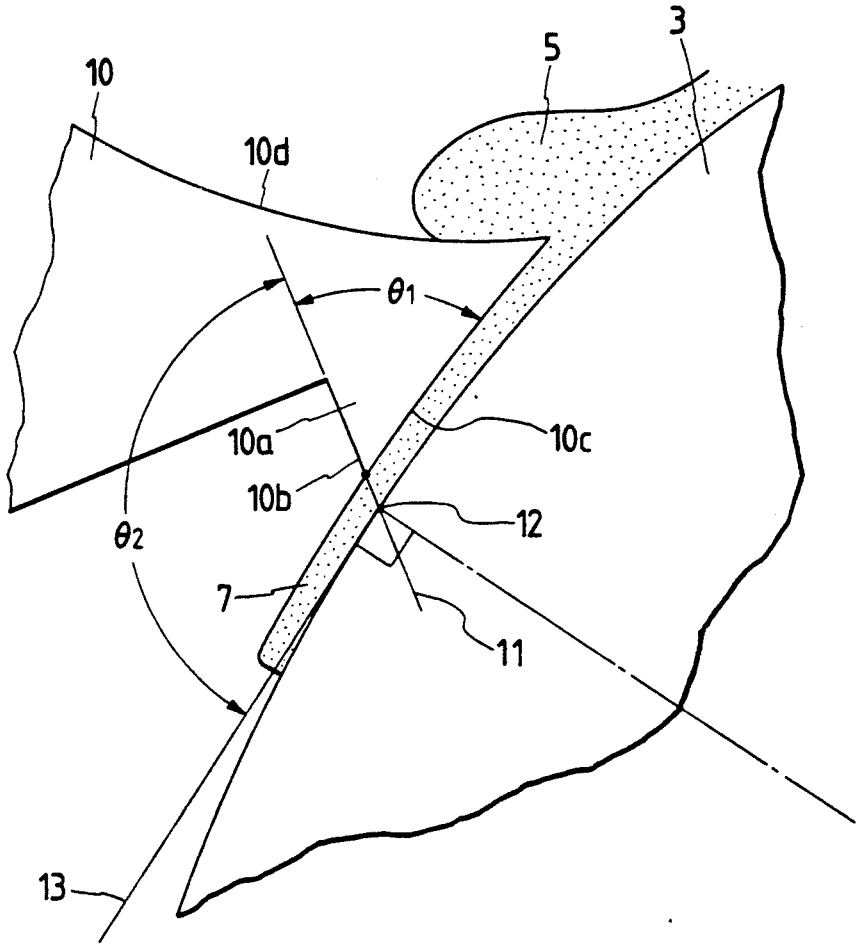
FIG. 2 is an enlarged view showing a portion A shown in FIG. 1.
Figure 3:
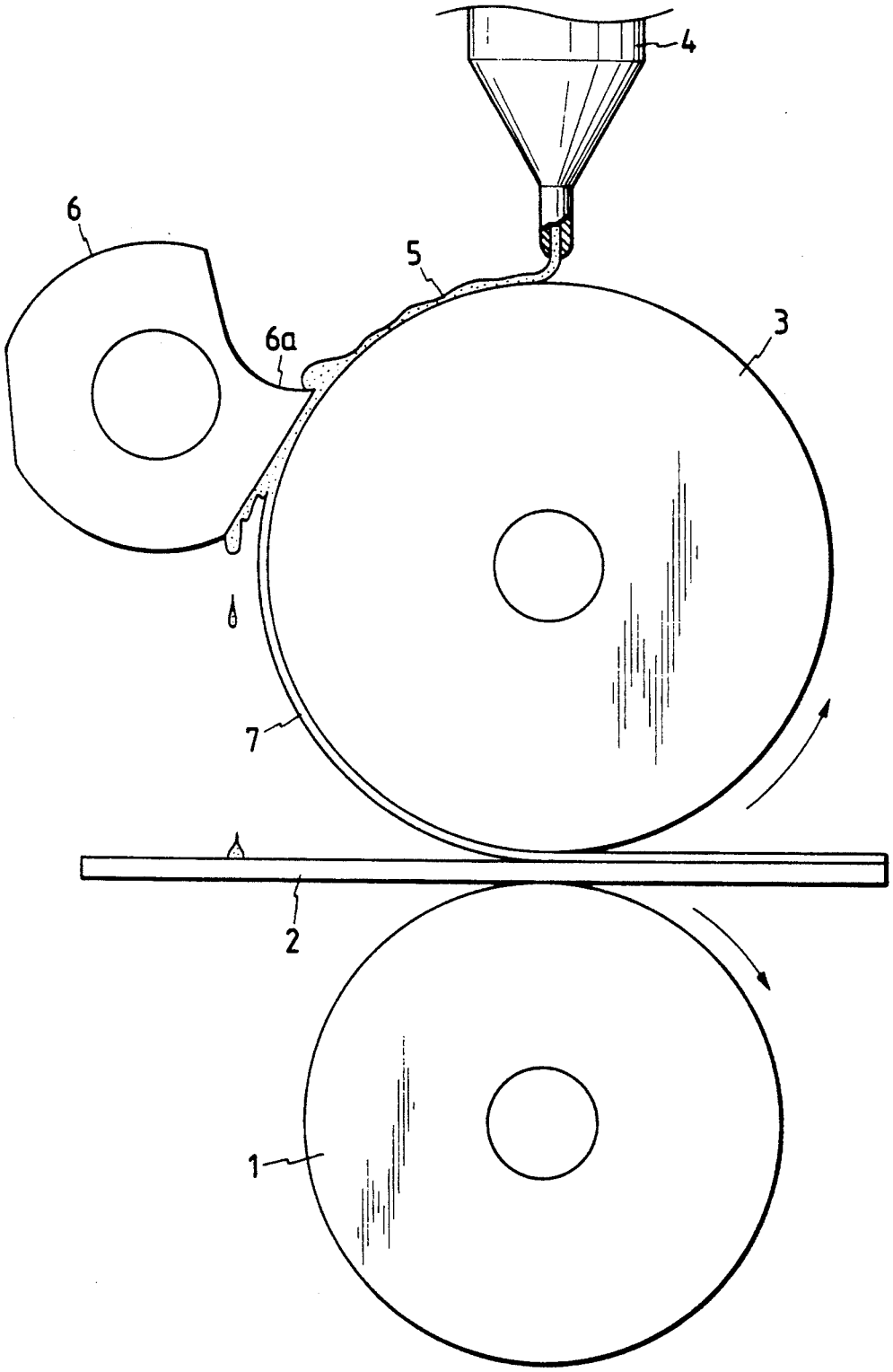
FIG. 3 PRIOR ART
FIG. 3 is a partially fragmentary sectional view showing a conventional roll coater.

As shown in FIG. 2, the facing surface 10*c* confronted with the surface of the upper roller 3 forms an angle $\theta_1$ of approximately 60 degree with the flank surface 10*b*. In other words, an "escape angle" of $\theta_2$ formed by the flank surface 10*b* with the surface of the upper roller 3, i.e., an angle defined between a tangential plane with which the upper roller 3 is contacted and an extension plane 11 of the flank surface 10*b* at an intersection 12 defined between the extension plane 11 and the upper roller surface is an obtuse angle at about 120 degrees. As described above, since the escape angle $\theta_2$ formed by the contact portion of doctor 10 relative to the upper roller 3 is obtuse angle, the coating 5 scraped by the rake surface 10*d* of doctor 10 could not move along and over the flank surface 10*b* side of the doctor 10, and is all formed on the surface of upper roller 3 as the constant thickness coating layer 7.

In this embodiment of the present invention, the coating 5 may include a hot melt adhesive or the like. The substrate 2 may include a disc-like member made of transparent resinous material. The hot melt adhesive is applied to one surface of the substrate. Thereafter, the substrate having the adhesive is bonded with one having the same shape (not shown). These steps are suitable for producing an optical video disc. The roll coater according to the present invention is suitable for applying onto disc substrates a hot melt adhesive as a protective layer or bonding adhesive for the optical disc as shown in, for example, the Japanese Patent Unexamined Publication No. Sho. 58-6536.

As described above, in the roll coater of the present invention, the coating supplied from the feeder is formed into a coating layer at a uniform thickness, because the escape angle formed by the contact portion of the doctor 10 relative to the upper roller 3 is an obtuse angle, so that the coating supplied from the feeder will not escape to the flank surface side of the doctor. As a result, all the coating is coated on the surface of the roller. Therefore, the coating is prevented from dropping onto the surface of the substrate.

What is claimed is:

1. An apparatus for applying a coating to a surface of an optical disk, comprising:

roller means rotatable in a predetermined direction for applying said coating onto a surface of said disk to be coated;

feed means for feeding said coating to said roller means; and doctor means positioned downstream of and below said feed means for regulating a thickness of said coating applied to said roller means, said doctor means having a facing surface facing a portion of a surface of said roller means, a flanking surface disposed on the bottom and downstream side of said doctor means and a rake surface disposed upstream of said facing surface for initially scraping excess coating from said roller means, wherein an escape angle defined between a tangential line, extending downstream from said doctor means, and said flanking surface is an obtuse angle, said tangential line being tangent to a point on the surface of the roller means at which a line extending along the plane of said flanking surface intersects the roller means surface.

2. The apparatus of claim 1, wherein said roller means comprises a lower roller and an associated upper roller which are rotated while clamping therebetween said substrate to be coated.

* * * * *